US008020632B2

(12) United States Patent
Moriarty

(10) Patent No.: US 8,020,632 B2
(45) Date of Patent: Sep. 20, 2011

(54) METHOD AND SYSTEM FOR WELLBORE COMMUNICATION

(75) Inventor: Keith A. Moriarty, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/173,707

(22) Filed: Jul. 15, 2008

(65) Prior Publication Data

US 2008/0277163 A1 Nov. 13, 2008

Related U.S. Application Data

(62) Division of application No. 11/381,381, filed on May 3, 2006, now Pat. No. 7,552,761.

(51) Int. Cl.
*E21B 47/12* (2006.01)

(52) U.S. Cl. ..... 175/40; 175/107

(58) Field of Classification Search ..... 175/40, 175/107; 367/84

See application file for complete search history.

(56) References Cited

U.S. PATENT DOCUMENTS

| | | | | |
|---|---|---|---|---|
| 2,352,833 | A | | 7/1944 | Hassler |
| 2,700,131 | A | | 1/1955 | Otis et al. |
| 3,065,416 | A | | 11/1962 | Jeter |
| 3,309,656 | A | | 3/1967 | Godbey |
| 3,713,089 | A | | 1/1973 | Clacomb |
| 3,764,970 | A | | 10/1973 | Manning |
| 4,015,234 | A | | 3/1977 | Krebs |
| RE29,734 | E | | 8/1978 | Manning |
| 4,535,429 | A | | 8/1985 | Russell et al. |
| 4,771,408 | A | | 9/1988 | Kotlyar |
| 4,805,449 | A | * | 2/1989 | Das ..... 73/152.48 |
| 4,847,815 | A | | 7/1989 | Malone |
| 5,103,430 | A | | 4/1992 | Jeter et al. |
| 5,163,521 | A | * | 11/1992 | Pustanyk et al. ..... 175/40 |
| 5,182,730 | A | | 1/1993 | Scherbatskoy |
| 5,215,152 | A | | 6/1993 | Duckworth |
| 5,237,540 | A | | 8/1993 | Malone |
| 5,249,161 | A | | 9/1993 | Jones et al. |
| 5,375,098 | A | | 12/1994 | Malone et al. |
| 5,517,464 | A | | 5/1996 | Lerner et al. |
| 5,583,827 | A | | 12/1996 | Chin |
| 5,586,084 | A | | 12/1996 | Barron et al. |
| 5,636,178 | A | * | 6/1997 | Ritter ..... 367/83 |
| 5,740,126 | A | | 4/1998 | Chin et al. |
| 5,774,420 | A | | 6/1998 | Heysse et al. |
| 6,105,690 | A | | 8/2000 | Biglin, Jr. et al. |
| 6,219,301 | B1 | | 4/2001 | Moriarty |
| 6,233,524 | B1 | * | 5/2001 | Harrell et al. ..... 702/9 |
| 6,421,298 | B1 | | 7/2002 | Beattie et al. |
| 6,626,253 | B2 | | 9/2003 | Hahn et al. |
| 6,708,783 | B2 | * | 3/2004 | Moore et al. ..... 175/45 |
| 6,788,219 | B2 | | 9/2004 | Sun et al. |
| 6,877,570 | B2 | * | 4/2005 | Chen et al. ..... 175/22 |
| 6,898,150 | B2 | | 5/2005 | Hahn et al. |
| 6,909,667 | B2 | | 6/2005 | Shah et al. |
| 6,920,085 | B2 | | 7/2005 | Finke |

(Continued)

*Primary Examiner* — Hoang Dang
(74) *Attorney, Agent, or Firm* — John Vereb; Jeremy Welch

(57) ABSTRACT

A communication system for a casing while drilling system is provided. The casing while drilling system is adapted to advance a bottom hole assembly into a subsurface formation via a casing. The communication system comprises a high frequency modulator and a transducer. The modulator is positioned in the bottom hole assembly and adapted to generate a mud pulse by selectively restrict mud flow passing therethrough. The transducer is adapted to detect the mud pulse generated by the modulator.

10 Claims, 6 Drawing Sheets

U.S. PATENT DOCUMENTS

| | | | | |
|---|---|---|---|---|
| 7,320,370 | B2 | 1/2008 | Virally et al. | |
| 2002/0117306 | A1 * | 8/2002 | Hahn et al. | 166/373 |
| 2003/0056985 | A1 | 3/2003 | Hahn et al. | |
| 2003/0151522 | A1 | 8/2003 | Jeffryes et al. | |
| 2003/0151978 | A1 | 8/2003 | Jeffreys et al. | |
| 2005/0000733 | A1 | 1/2005 | Schaaf | |
| 2005/0012637 | A1 | 1/2005 | Golla et al. | |
| 2005/0260089 | A1 | 11/2005 | Hahn et al. | |
| 2005/0284659 | A1 | 12/2005 | Hall et al. | |

* cited by examiner

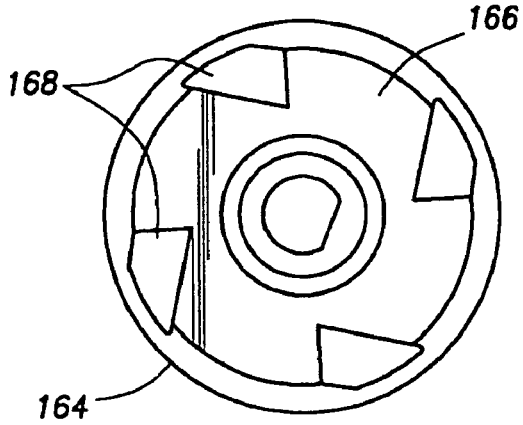
FIG.4A
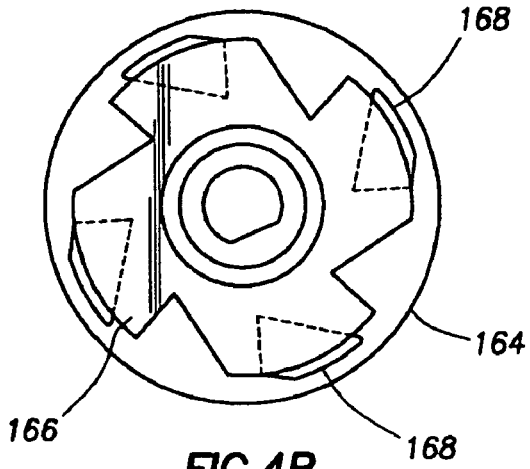
FIG.4B
FIG.5A
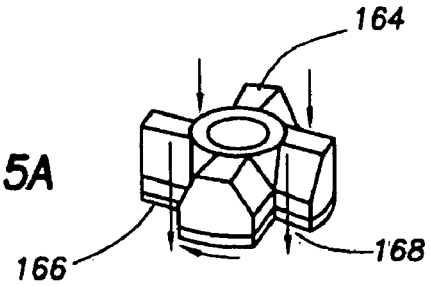
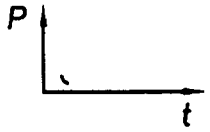
FIG.6A
FIG.5B
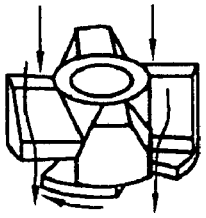
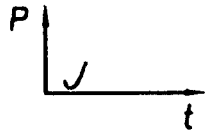
FIG.6B
FIG.5C
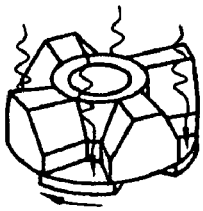
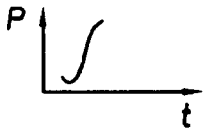
FIG.6C
FIG.5D
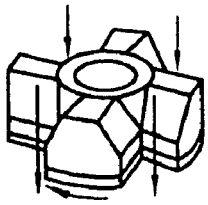
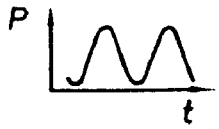
FIG.6D

METHOD AND SYSTEM FOR WELLBORE COMMUNICATION

CROSS-REFERENCE APPLICATION

This application claims priority to U.S. Provisional Application No. 60/683,756, entitled "Method and Apparatus for Wellbore Communication" filed on May 23, 2005, which is hereby incorporated in its entirety.

BACKGROUND OF THE INVENTION

The present invention relates to telemetry systems for use in wellbore operations. More particularly, the present invention relates to telemetry systems for providing power to downhole operations and/or for passing signals between a position in a wellbore penetrating a subterranean formation and a surface unit Wells are generally drilled into the ground to recover natural deposits of hydrocarbons and other desirable materials trapped in geological formations in the Earth's crust. A well is typically drilled by advancing a drill bit into the earth. The drill bit is attached to the lower end of a "drill string" suspended from a drilling rig. The drill string is a long string of sections of drill pipe that are connected together end-to-end to form a long shaft for driving the drill bit further into the earth. A bottom hole assembly (BHA) containing various instrumentation and/or mechanisms is typically provided above the drill bit. Drilling fluid, or mud, is typically pumped down through the drill string to the drill bit. The drilling fluid lubricates and cools the drill bit, and it carries drill cuttings back to the surface in the annulus between the drill string and the borehole wall.

During conventional measurement while drilling (MWD) or logging while drilling (LWD) operations, signals are passed between a surface unit and the BHA to transmit, for example commands and information. Typically, the surface unit receives information from the BHA and sends command signals in response thereto. Communication or telemetry systems have been developed to provide techniques for generating, passing and receiving such signals. An example of a typical telemetry system used involves mud-pulse telemetry that uses the drill pipe as an acoustic conduit for mud pulse telemetry. With mud pulse telemetry, mud is passed from a surface mud pit and through the pipes to the bit. The mud exits the bit and is used to contain formation pressure, cool the bit and lift drill cuttings from the borehole. This same mud flow is selectively altered to create pressure pulses at a frequency detectable at the surface and downhole. Typically, the operating frequency is in the order 1-3 bits/sec, but can fall within the range of 0.5 to 6 bits/sec. An example of mud pulse telemetry is described in U.S. Pat. No. 5,517,164, the entire contents of which are hereby incorporated.

In conventional drilling, a well is drilled to a selected depth, and then the wellbore is typically lined with a larger-diameter pipe, usually called casing. Casing typically consists of casing sections connected end-to-end, similar to the way drill pipe is connected. To accomplish this, the drill string and the drill bit are removed from the borehole in a process called "tripping." Once the drill string and bit are removed, the casing is lowered into the well and cemented in place. The casing protects the well from collapse and isolates the subterranean formations from each other. After the casing is in place, drilling may continue or the well may be completed depending on the situation.

Conventional drilling typically includes a series of drilling, tripping, casing and cementing, and then drilling again to deepen the borehole. This process is very time consuming and costly. Additionally, other problems are often encountered when tripping the drill string. For example, the drill string may get caught up in the borehole while it is being removed. These problems require additional time and expense to correct.

The term "casing drilling" refers to the use of a casing string in place of a drill string. Like the drill string, a chain of casing sections are connected end-to-end to form a casing string. The BHA and the drill bit are connected to the lower end of a casing string, and the well is drilled using the casing string to transmit drilling fluid, as well as axial and rotational forces, to the drill bit. Upon completion of drilling, the casing string may then be cemented in place to form the casing for the wellbore. Casing drilling enables the well to be simultaneously drilled and cased. Examples of such casing drilling are provide in U.S. Pat. No. 6,419,033, US Patent Application No. 20040104051 and PCT Patent Application No. WO00/50730, all of which are incorporated herein by reference.

Despite the advances in casing drilling technology, current casing drilling systems are unable to provide high speed communication between the surface and the bottom hole assembly. Therefore, what is needed is a system and method to provide a casing drilling system with high speed, low attenuation rate and/or enhanced band width signal capabilities.

SUMMARY OF INVENTION

In at least one respect, the present invention includes a communication system and method for a casing while drilling system. The casing while drilling system is adapted to advance a into a subsurface formation via a casing. The communication system includes a high frequency modulator and a transducer. The modulator is positioned in the bottom hole assembly and adapted to generate a mud pulse by selectively restricting the mud flow passing therethrough. The transducer is adapted to detect the mud pulse generated by the modulator.

In another aspect, the invention relates to a method of communicating with a bottom hole assembly of a casing while drilling system. The casing while drilling system is adapted to advance the bottom hole assembly into a subsurface formation via a casing. The method includes generating mud pulses at predefined frequencies by selectively restricting a mud flow passing through a modulator of the bottom hole assembly and detecting the mud pulses at the surface.

BRIEF DESCRIPTION OF DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

FIG. 4A is a detailed view of the modulator of FIG. 2 with the rotor in the open position relative to the stator.

FIG. 4B is a detailed view of the modulator of FIG. 2 with the rotor in the closed position relative to the stator.

FIGS. 5A-D are schematic views of the rotor and stator of FIG. 3 depicting the movement of the rotor relative to the stator.

FIGS. 6A-D are graphs depicting the relationship between pressure versus time for the rotors and stators depicted in FIGS. 5A-D, respectively.

DETAILED DESCRIPTION

Figure 1:
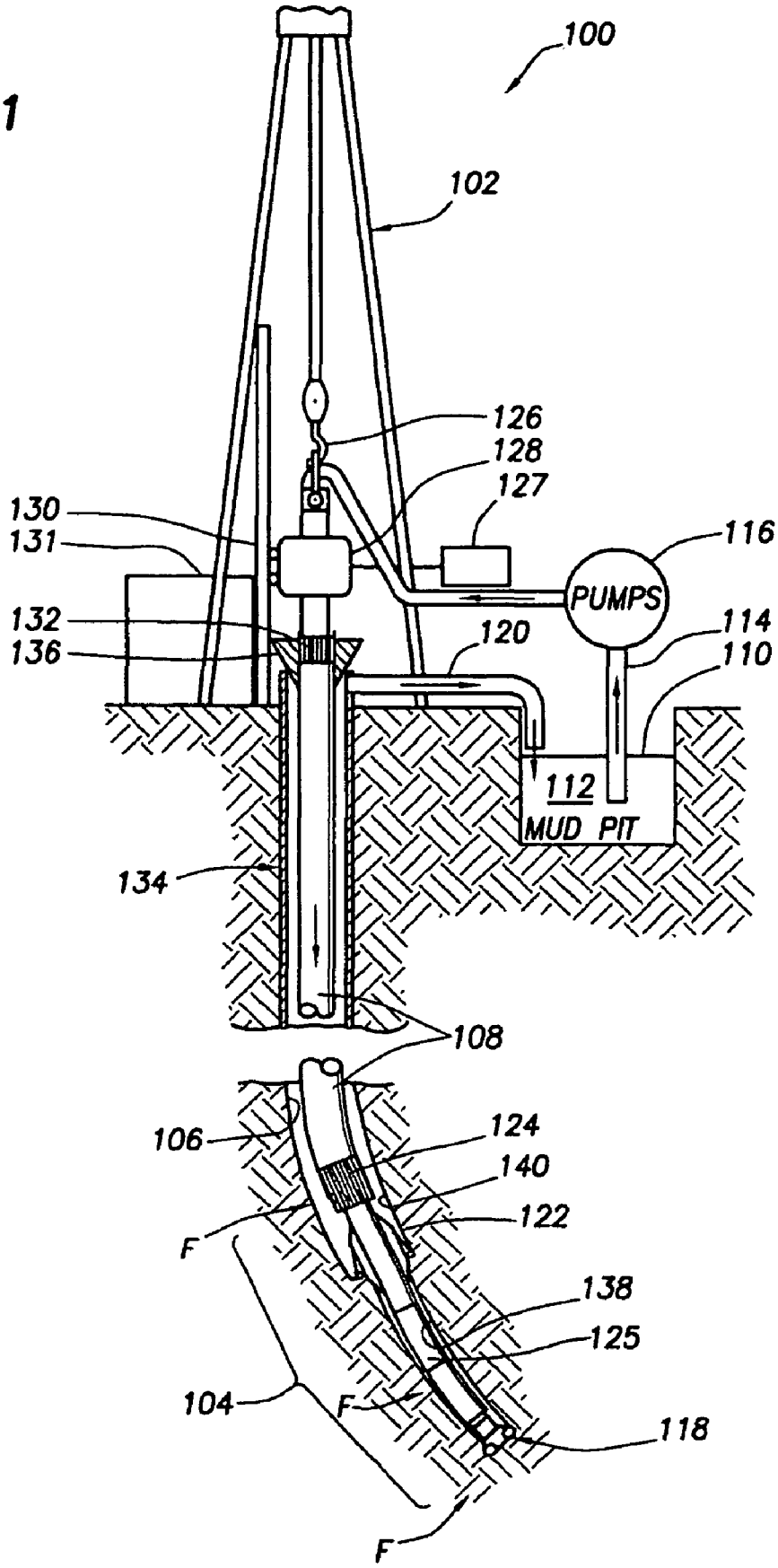
FIG. 1 is a schematic view, partially in cross-section, of a rig having a casing drilling system for drilling a wellbore, the casing drilling system provided with a casing drilling communication system.

Referring to FIG. 1, a casing drilling system 100 includes a rig 102 with a bottom hole assembly (BHA) 104 deployed into a borehole 106 via a casing 108. The rig 102 has a traveling hook/block 126, top drive 128, guide rail and top drive/block dolly 130 and draw works 131. A casing drive head/assembly 132 operatively connects the casing to the top drive 128. The casing 108 extends through a conductor pipe 134. Casing slips 136 are used to suspend the casing 108 string when adding a new joint of casing as drilling depth increases.

In one embodiment, the BHA 104 includes a drill bit 118 at a downhole end thereof, a rotary steerable (RSS), measurement while drilling (MWD) and/or logging while drilling (LWD) assembly 125, and an under reamer 122. A BHA latch & seal assembly 124 operatively connects the BHA 104 to the casing 108. Preferably, the latch & seal assembly 124 and the BHA 104 are retrievable through the casing 108. The MWD/LWD assembly 125 preferably includes or communicates with a telemetry system or modulator, which is described in detail below, for communication with an acquisition and demodulation unit 127. The acquisition and demodulation unit 127 typically resides in a surface unit, cabin or enclosure (not shown).

A surface mud pit 110 with a mud 112 therein is positioned near the rig 102. Mud 112 is pumped through feed pipe 114 by pump 116 and through the casing 108 as indicated by the arrows. Mud 112 passes through the BHA 104, out the drill bit 118 and back up through the borehole 106. Mud 112 is then driven out an outlet pipe 120 and back into mud pit 110.

The drill bit 118 advances into a subterranean formation F and creates a pilot hole 138. The under reamer 122 advances through the borehole 106, expands the pilot hole 138 and creates an under-reamed hole 140. The BHA 104 is preferably retrievable through the casing 108 on completion of the drilling operation. The under reamer 122 is preferably collapsible to facilitate retrieval through the casing 108.

Figure 2A:
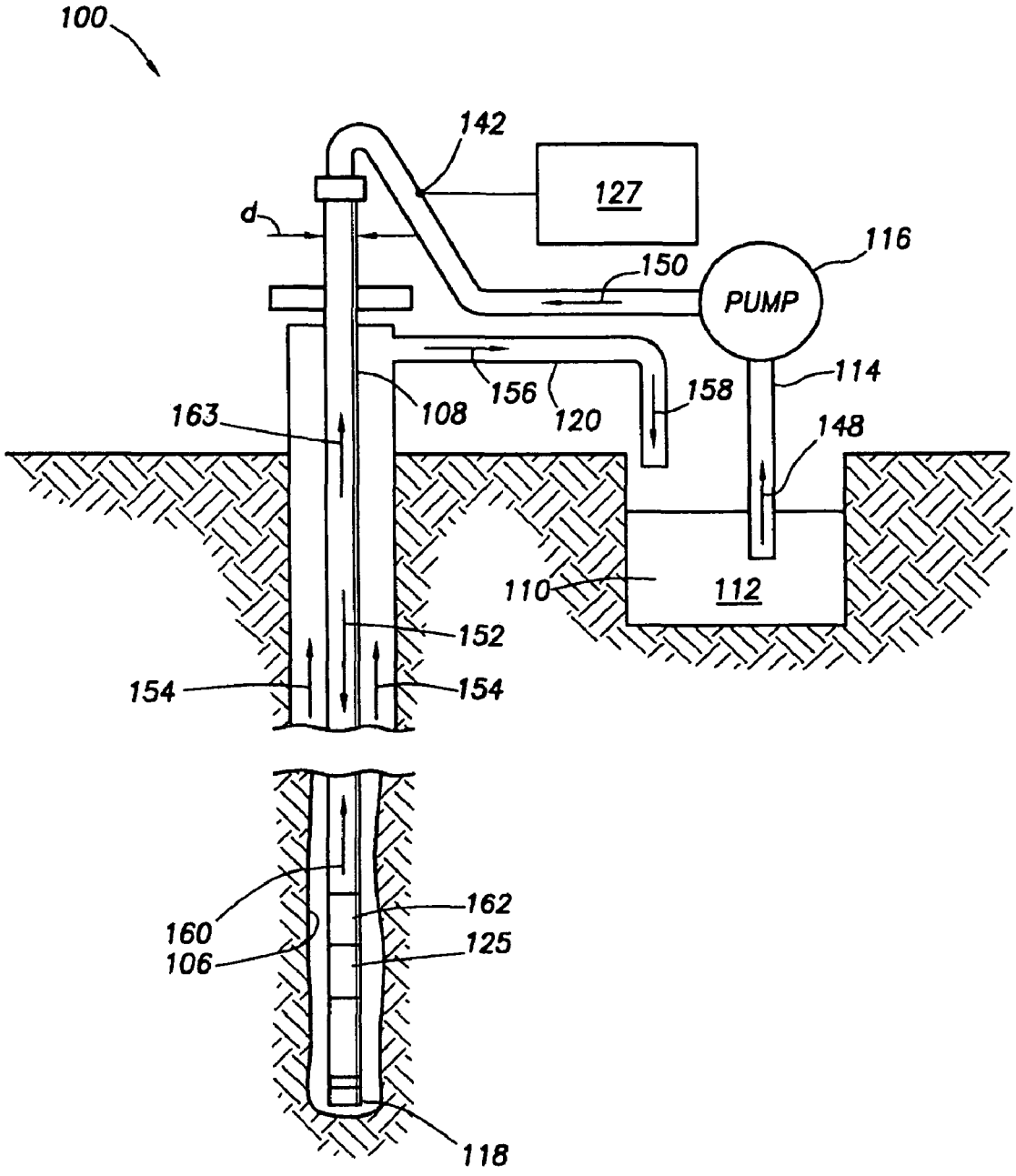
FIG. 2A is a detailed view of the casing drilling system of FIG. 1, the casing drilling system can entail a drilling, measurement, and/or formation evaluation assembly such as a rotary steerable (RSS), measurement while drilling (MWD) and/or logging while drilling (LWD) system and a modulator.

Referring now to FIG. 2A depicts a portion of the casing drilling system 100 of FIG. 1 in greater detail. As mud 112 is pumped from feed pipe 114 through pump 116, it passes by a pressure transducer 142 and down through the casing 108 to an RSS, MWD, and/or LWD assembly 125 as indicated by arrows 148, 150, and 152. The mud 112 passes through the BHA 104, exits the drilling bit 118 and returns through borehole 106 as indicated by arrows 154, 156 and 158.

The RSS, MWD, and/or LWD assembly 125 uses a mud pulse system, such as the one described in U.S. Pat. No. 5,517,464, which is incorporated herein by reference. The RSS, MWD, and/or LWD assembly 125 includes a modulator 162 adapted to communicate with a surface unit (not shown). As mud 112 passes through the modulator 162, the modulator 162 restricts the flow of the mud 112 and hence the pressure to generate a signal that travels back through the casing 108 as indicated by arrows 160 and 163. The pressure transducer 142 detects the changes in mud pressure caused by the modulator 162. The acquisition and demodulation unit 127 processes the signal thereby allowing the 104 to communicate to the surface through the unit 127 for uphole data collection and use.

Figure 2B:
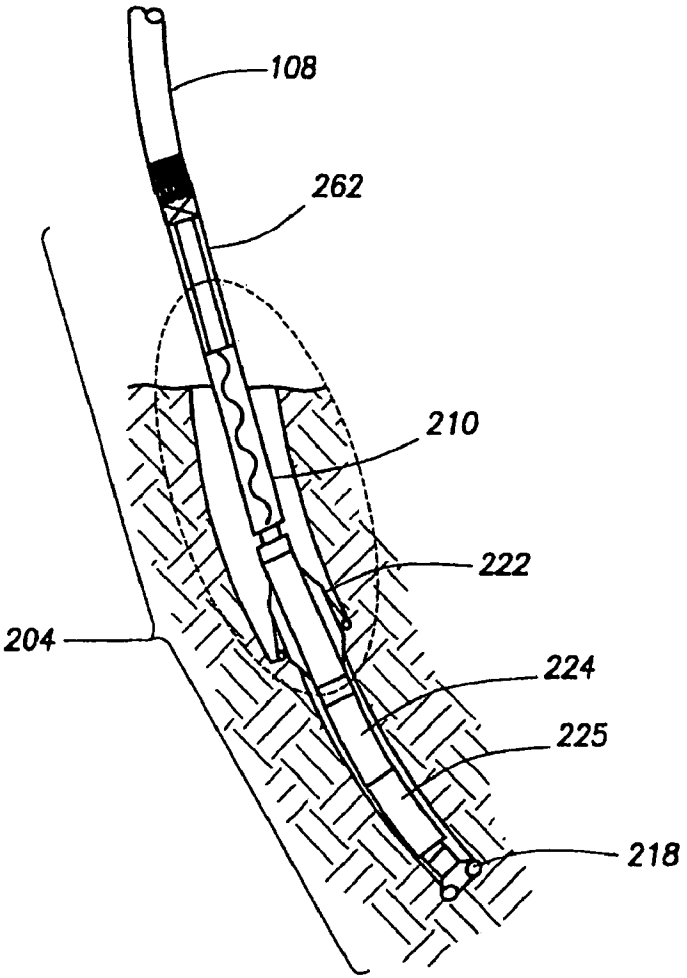
FIG. 2B is a detailed view of the casing drilling system of FIG. 1, wherein the casing drilling communication system is run with a mud motor or turbo drill and the communication system is located uphole relative to the mud motor.

Referring now to FIG. 2B, an alternative embodiment is shown wherein a BHA 204 includes a drilling, measurement, and/or formation evaluation assembly 225, such as RSS, MWD, and/or LWD, a mud motor or turbo-drill 210, a drill bit 218, an under-reamer 222, and a data transmission module 224. The mud motor 210 is located downhole or below a casing drilling modulator 262, which is similar to the modulator 162 of FIG. 2A. Using a mud or drilling motor, such as the mud motor 210, provides the advantage of reducing the amount of rotations on the casing 108. In one embodiment, the modulator 262 communicates with the transmission module 224, which is in communication with other components or elements of the BHA 204. In an alternative embodiment, the modulator 262 communicates directly with the other elements in the BHA 204 including the RSS, MWD, and/or LWD assembly 225 through various means including wired or wireless such as electromagnetic or ultrasonic methods. The scope of the present invention is not limited by the mean used for communication, which includes but is not limited to transmission through wired methods or wireless methods, which could include electromagnetic, ultrasonic or other means, or a combination thereof, such a wired and wireless or ultrasonic and electromagnetic combined with wired communication. Positioning the mud motor 210 downhole relative to the modulator 262 is the present embodiment which limits signal attenuation and produces the higher data rate and depth capability.

Figure 3:
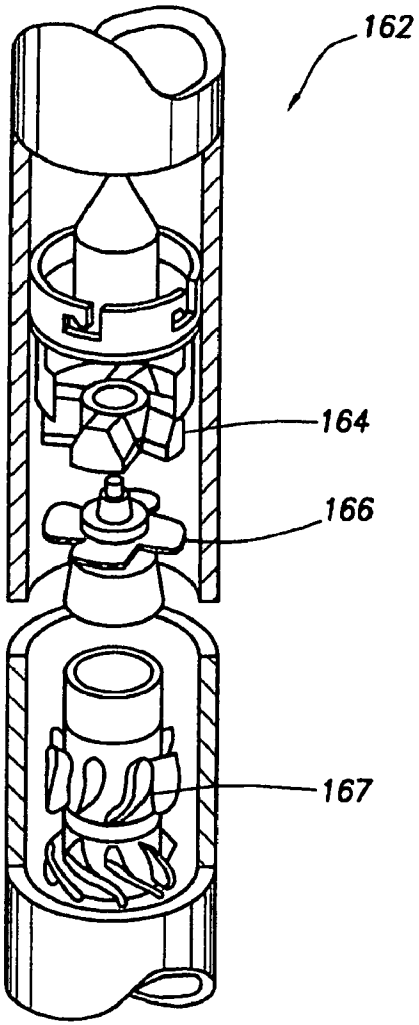
FIG. 3 is a detailed, exploded view of the modulator of FIG. 2 having a stator and a rotor.

Referring now to FIG. 3, the modulator 162 of FIG. 2A and modulator 262 of FIG. 2B are depicted in greater detail. In each of the embodiments set forth herein, the modulator are similar in operation. Accordingly, even though the operation of one of the modulators is discussed in detail, the operation and results are applicable to similar types of modulators shown in alternative embodiments. The modulator 162 includes a stator 164, rotor 166 and turbine 167. The modulator 162 may be, for example, of the type described in U.S. Pat. No. 5,517,464, already incorporated herein by reference. In one embodiment, the modulator 162 is preferably a rotary or siren type modulator. Such modulators are typically capable of high speed operation, which can generate high frequencies and data rates. Alternatively, in another embodiment conventional "poppet" type or reciprocating pulsers may be used, but they tend to be limited in speed of operation due to limits of acceleration/deceleration and motion reversal with associated problems of wear, flow-erosion, fatigue, power limitations, etc.

As the mud flow passes through the turbine 167, the mud flow turns the turbine 167 and the rotation of the turbine 167 caused by the flow of mud generates power that can be used to power any required part of portion the BHA 104, including the rotor 166 of modulator 162.

FIGS. 4A and 4B show the position of the rotor 166 and stator 164. In FIG. 4A, the rotor 166 is in the open position. In other words, the rotor 166 is aligned with the stator 164 to permit fluid to pass through apertures 168 therebetween.

In FIG. 4B, the rotor 166 is in the closed position, such that the apertures 168 are blocked, at least partially. In other words, the rotor 166 is mis-aligned with respect to the stator 164 to block at least a portion of the fluid passing through apertures 168 therebetween. The movement between the open and closed position creates a 'pressure pulse.' This pressure pulse is a signal detectable at the surface, and is used for communication.

Referring now to FIGS. 5A-D, the flow of fluid past the rotor 166 and stator 164 is shown in greater detail in FIGS. 5A-D. In the open position (FIG. 5A), fluid passes with the least amount of restriction past stator 164 and rotor 166.

As the rotor 166 rotates and blocks a portion of the aperture 168 (FIG. 5B), fluid is partially restricted, thereby causing a change in pressure over time. The rotor 166 then rotates to a more restricted or closed position (FIG. 5C) and restricts at least a portion of the fluid flow. The rotor 166 advances further until it returns to the unobstructed position (FIG. 5D).

Referring now to FIGS. 6A-D, the change in pressure over time is displayed in graphs of pressure-versus-time plots of the fluid flow for each of the rotor positions of FIGS. 5A-D, respectively.

The following equations show the general effect of various parameters of the mud pulse signal strength and the rate of attenuation:

$$S=S_o\exp[-4\pi F(D/d)^2(\mu/K)]$$

where

S=signal strength at a surface transducer;

$S_o$=signal strength at the downhole modulator;

F=carrier frequency of the MWD signal expressed

D=measured depth between the surface transducer and the downhole modulator d=inside diameter of the drill pipe (same units as measured depth);

Ξ=plastic viscosity at the drilling fluid; and

K=bulk modulus of the volume of mud above the modulator, and by the modulator signal pressure relationship $$S_o\propto(\rho_{mud}\times Q^2)/A^2$$

where $S_o$=signal strength at the downhole modulator;

$\rho_{mud}$=density of the drilling fluid;

Q=volume flow rate of the drilling fluid; and

A=the flow area with the modulator in the "closed" position

The foregoing relationships demonstrate that a larger diameter of pipe, such as the casing 108, makes higher carrier frequencies and data rates possible since the attenuation rate is lower for larger pipe diameters. Thus, for the specific application of casing drilling, the effect of the inside diameter "d", as shown in FIG. 2, makes higher carrier frequencies (hence, data rates) possible since the rate of attenuation is much less compared to conventional drill pipe. Accordingly, the ability to transmit at high frequencies and, hence the scope of the present invention, is determined by the foregoing relationships. The specific data rates provided below are for illustration purposes and not intended as a limiting example.

Figure 7:
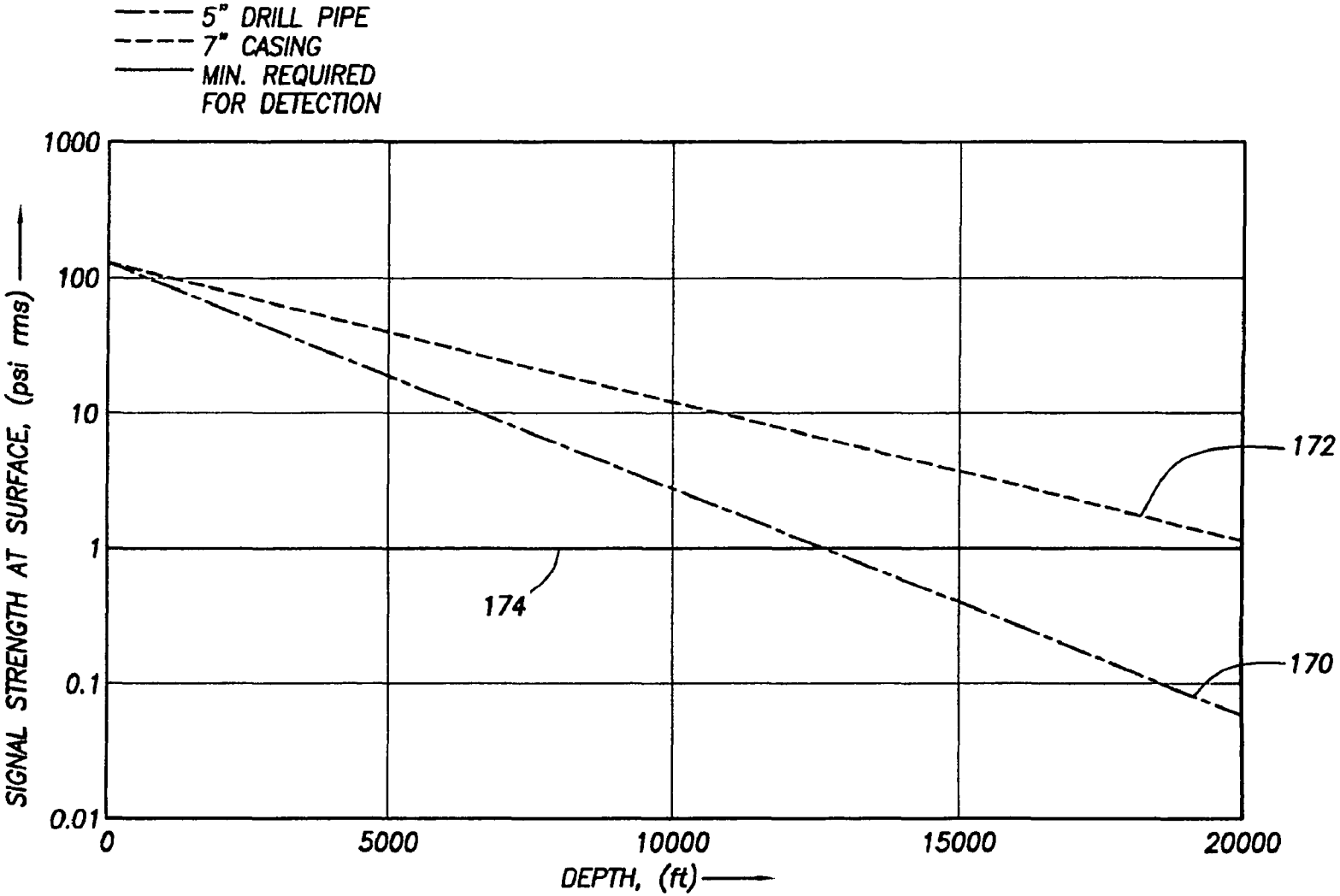
FIG. 7 is a graph depicting signal strength versus depth at a first frequency and bit rate.
Figure 8:
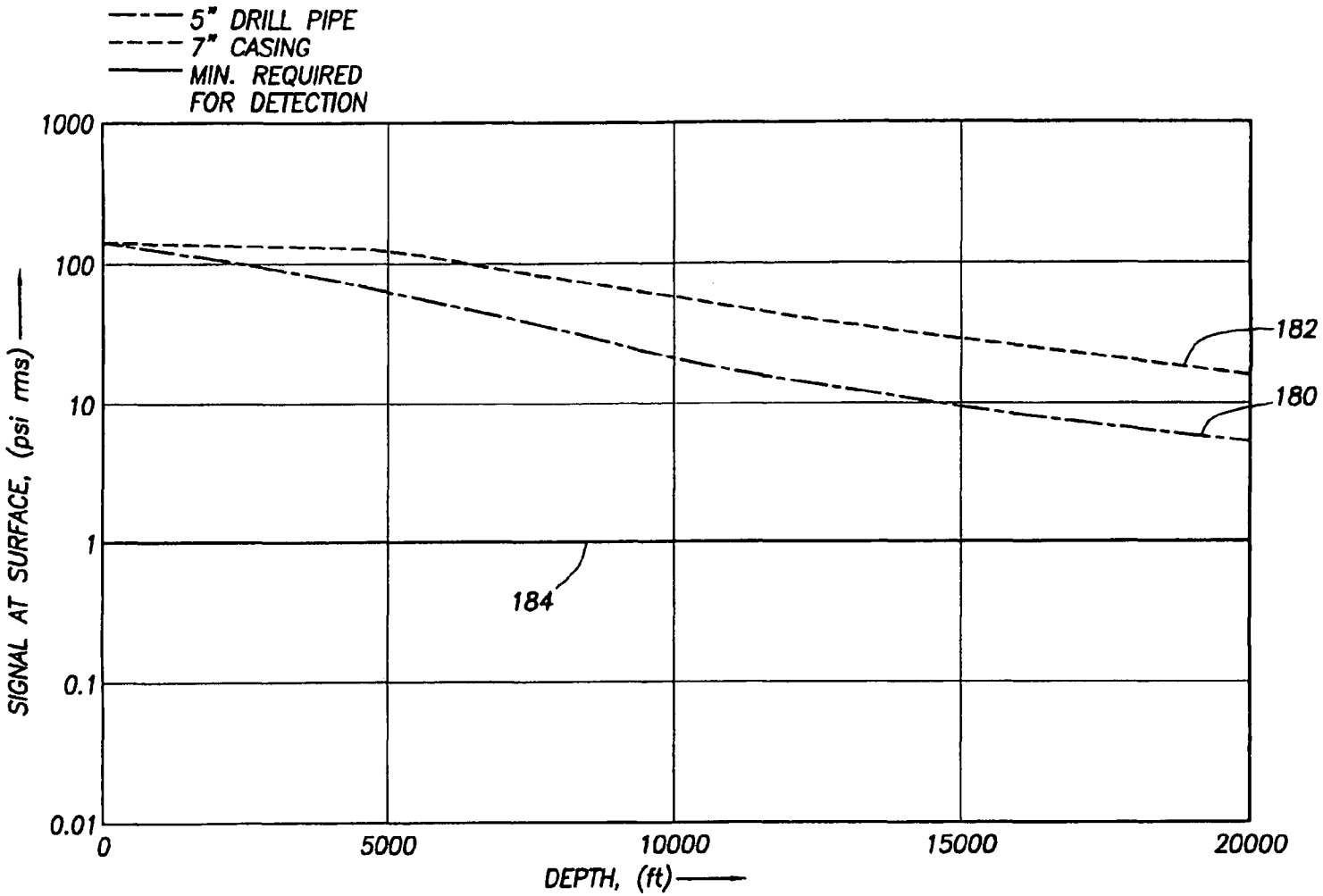
FIG. 8 is a graph depicting signal strength versus depth at a second frequency and bit rate.

Referring now to FIGS. 7 and 8, graphs comparing the signal strength (y-axis) at various depths (x-axis) for a drill pipe in comparison to a casing. FIG. 7 shows the signal strength for a 5" drill pipe (170) and a 7" casing (172). A minimum level (174) for detecting signal strength is also depicted. The graph illustrates the effect diameter has on signal strength in a 24 hz-12 bit/second deep water application using synthetic oil based mud. This shows that with the larger internal diameter of casing, 12 bit/sec telemetry rate is possible to about 20000 feet as compared to the smaller drill pipe diameter where 12 bit/sec is limited to about 13000 feet. Thus, the communication system described herein in this example can operate in the range of 1 bit/sec up to 12 bits/sec depending on the casing diameter and depth.

FIG. 8 shows the signal strength for a 5" drill pipe (180) and a 7" casing (182). A minimum level (184) for detecting signal strength is also depicted. The graph illustrates the effect diameter has on signal strength in a 1 hz-1 bit/second deep water application using synthetic oil based mud. Typically, telemetry with drill pipe will be limited to 1 bit/sec, hence there is one order of magnitude higher data rate possible in these conditions with casing as compared to drill pipe. There is also an approximately four-fold increase in signal amplitude with casing as compared to drill-pipe for 1 Hz telemetry.

It should be noted that both of the examples illustrated in FIGS. 7 and 8 are for comparison purpose only and that by changing the relevant parameters in the previously stated relationships, an increase in depth and/or data rate capability is possible.

It will be understood from the foregoing description that various modifications and changes may be made in the preferred and alternative embodiments of the present invention without departing from its true spirit. Furthermore, this description is intended for purposes of illustration only and should not be construed in a limiting sense. The scope of this invention should be determined only by the language of the claims that follow. The term "comprising" within the claims is intended to mean "including at least" such that the recited listing of elements in a claim are an open set or group. Similarly, the terms "containing," having," and "including" are all intended to mean an open set or group of elements. "A" or "an" and other singular terms are intended to include the plural forms thereof unless specifically excluded.

What is claimed is:

1. A casing-while-drilling system that advances a bottom hole assembly having a drill bit into a subsurface formation along a wellbore that is at least partially cased, comprising:

a modulator that generates mud pulses at a high frequency selected based on an inner diameter of the casing;

a tool assembly configured for at least one of drilling measurements and formation measurements; and a mud motor that converts mud flow into rotation of the drill bit;

wherein the modulator is positioned at a location uphole relative to the mud motor and the tool assembly is positioned at a location downhole relative to the mud motor; and wherein the modulator is in communication with the tool assembly despite the position of the mud motor therebetween;

wherein a signal strength at a surface transducer is generated by the modulator according to a formula $S=S_0 \exp[-4\pi F (D/d)^2(\mu/K)]$.

2. The casing-while drilling system of claim 1, wherein the modulator is in electromagnetic communication with the tool assembly, said electromagnetic communication being about the mud motor.

3. A method for wellbore communication during casing-while-drilling operations, comprising:

positioning a bottomhole assembly in a wellbore that is at least partially cased during drilling operations with a casing, the bottomhole assembly comprising a drill bit, a mud pulse modulator, a mud motor, and a tool assembly configured for at least one of drilling measurements and formation measurements; wherein an operating frequency of the mud pulse modulator is selected based on an inner diameter of the casing;

wherein the mud pulse modulator is positioned at a location uphole relative to the mud motor and the tool assembly is positioned at a location downhole relative to the mud motor, and wherein the modulator is in communication with the tool assembly despite the position of the mud motor therebetween; and casing an uncased portion of the wellbore substantially simultaneously while drilling into the formation with the drill bit; wherein a signal strength at a surface transducer is generated by the modulator according to a formula $S=S_0 \exp[-4\pi F (D/d)^2(\mu/K)]$.

4. The method according to claim 3, wherein during the casing-while-drilling operation, the drill bit is positioned in a portion of the wellbore that is not yet cased.

5. The method according to claim 3, wherein during the casing-while-drilling operation, the tool assembly is positioned in a portion of the wellbore that is not yet cased.

6. The method according to claim 3, further comprising adding a length of casing as the casing-while-drilling operation progresses.

7. The method according to claim 3, further comprising passing data from the tool assembly to the mud pulse modulator via a first telemetry and passing the data from the mud pulse modulator to the surface via mud pulse telemetry at a high rate of frequency.

8. The method according to claim 3, further comprising minimizing rotation of the casing during the casing-while-drilling operations.

9. The method according to claim 7, further comprising selecting a casing having an inner diameter of at least a threshold size to increase the high rate of frequency.

10. The method according to claim 3, wherein the modulator is in communication with the tool assembly via wireless communication comprising one of electromagnetic and ultrasonic.

* * * * *